US007264692B2

(12) United States Patent
Isometsä et al.

(10) Patent No.: US 7,264,692 B2
(45) Date of Patent: Sep. 4, 2007

(54) METHOD FOR MONITORING THE OPERATION OF A DOCTOR ASSEMBLY IN A PAPER MACHINE AND A DOCTOR ASSEMBLY FOR IMPLEMENTING THE METHOD

(75) Inventors: Juha Isometsä, Jyväskylä (FI); Tuomo Juvakka, Jyskä (FI); Seppo Parviainen, Jyväskylä (FI); Ilkka Rata, Jyväskylä (FI); Mika Saari, Jyväskylä (FI); Juhani Vestola, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 510 days.

(21) Appl. No.: 10/474,538

(22) PCT Filed: Apr. 10, 2002

(86) PCT No.: PCT/FI02/00299

§ 371 (c)(1),
(2), (4) Date: Feb. 19, 2004

(87) PCT Pub. No.: WO02/084023

PCT Pub. Date: Oct. 24, 2002

(65) Prior Publication Data

US 2004/0123965 A1 Jul. 1, 2004

(30) Foreign Application Priority Data

Apr. 11, 2001 (FI) ..... 20010752

(51) Int. Cl.
*D21F 11/00* (2006.01)

(52) U.S. Cl. ..... 162/198; 162/263; 162/199; 700/127; 700/128; 700/129

(58) Field of Classification Search ..... 162/198, 162/263, 199; 700/127, 128, 129
See application file for complete search history.

(56) References Cited

FOREIGN PATENT DOCUMENTS

| | | | |
|---|---|---|---|
| EP | 0 989 234 A2 | | 6/1999 |
| EP | 0989234 | * | 3/2000 |
| WO | WO99/25921 A1 | | 5/1999 |
| WO | WO99/46826 A1 | | 9/1999 |
| WO | WO 02/084023 A1 | | 4/2002 |

OTHER PUBLICATIONS

International Preliminary Examination Report for PCT/FI02/00299, Oct. 2002.
International Search Report for PCT/FI02/00299, Jul. 2002.

* cited by examiner

*Primary Examiner*—Mark Halpern
(74) *Attorney, Agent, or Firm*—Stiennon & Stiennon

(57) ABSTRACT

The operation of a doctor assembly (16) in a paper machine is monitored. In case of a malfunction, the paper machine's (10) control devices (14-14', 15) are used to carry out the necessary measures for eliminating the malfunction and carrying out repair and/or protective measures. In addition, detector devices (20) are arranged in connection with the doctor assembly (16), to detect a malfunction. The detector devices (20) are connected to the control devices (14, 14', 15) of the paper machine (10), in order to carry out the said measures automatically. The invention also relates to doctor assemblies in a paper machine for implementing the method.

25 Claims, 5 Drawing Sheets

METHOD FOR MONITORING THE OPERATION OF A DOCTOR ASSEMBLY IN A PAPER MACHINE AND A DOCTOR ASSEMBLY FOR IMPLEMENTING THE METHOD

CROSS REFERENCES TO RELATED APPLICATIONS

This application claims priority on Finnish Application No. 20010752, Filed Apr. 11, 2001, and is a U.S. National Stage application of International Application No. PCT/FI02/00299, filed Apr. 10, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for monitoring the operation of a doctor assembly in a paper machine, a doctor member belonging to the doctor assembly being used to scrape material off a moving surface. Detector devices are arranged in connection with the doctor assembly and are used to monitor the operation of the doctor assembly and, if the doctor member drops through, to perform, together with the paper machine's control devices connected to the detector devices, the measures necessary to run down, before the doctor assembly being monitored, the web being manufactured on the paper machine, in order to eliminate the disturbance caused by the drop-through and to perform repair and/or protective measures. The invention also relates to a doctor assembly for implementing the method.

U.S. Pat. No. 5,021,124 discloses a doctor assembly, in which there are two doctor blades. An excellent doctoring result can be achieved using the disclosed doctor assembly, as individual doctor beams, which can be adjusted together or independently of each other, are arranged for each doctor blade. In addition, the construction permits material doctored off the surface being doctored with the second doctor blade to be removed from between the doctor beams. The space is required especially when the paper web is being run down, if the first doctor blade, so to say, drops through the paper web. In that case, the entire paper web runs between the doctor beams and down into the pulper.

A major problem in the doctor described above, and in others, concerns malfunctions, in which the doctor assembly does not operate as designed. This is because few malfunctions are noticed in time. Generally, the operating personnel notices a malfunction quite by accident. Even a small malfunction, if it continues for a long time, can result in great damage to equipment, particularly in the press section of a paper machine. On the other hand, one significant problem in a modern high-speed paper machine is precisely the second doctor blade becoming blocked, if the first doctor blade drops through. A large amount of material then rapidly collects on top of the doctor beams, and can even bend them. In any event, cleaning the doctor assembly is laborious, despite the washing sprays. A corresponding situation occurs, if the pulper malfunctions and the doctored material collects in the doctor assembly, bending the doctor beams. Both doctor blades can then drop through. Dropping through and a poor doctoring result are also disadvantageous to the operation of doctors located in other positions too. Using the state of the art it is, however, practically impossible to detect malfunctions and prevent damage.

European patent application number 989234 discloses a doctor, which is used to scrape a press roll. In this doctor, the angle of the blade holder or the doctor blade is monitored by means of sensors, which are connected to the control of the pick-up roll. For example, a sudden change in the angle of the blade holder is detected as a malfunction, in which case the pick-up roll is raised to avoid damage to the press. However, it is impossible to use the arrangement disclosed to detect a drop through, or other malfunctions of the doctor.

In a drop through, there is, after the doctor blade, material on the surface being doctored, which remains unnoticed when monitoring the angle. Thus, the assembly disclosed is mainly only suitable for detecting foreign bodies and random accumulations of material on the press. The assembly will also easily give false alarms, if it is set to detect very small changes in angle or position. Correspondingly, if the assembly reacts only to large changes, it will be too late to prevent damage.

SUMMARY OF THE INVENTION

The invention is intended to create a new type of method for monitoring the operation of a doctor assembly in a paper machine, by means of which malfunctions, such as particularly a drop through, can be detected and corrected, and/or protective measures can be taken easily and above all rapidly. The invention is also intended to create a new type of doctor assembly in a paper machine, which will allow various kinds of malfunction to be detected rapidly, thus avoiding further damage caused by malfunctions.

In the doctor assembly according to the invention, there are special devices for monitoring the operation of the doctor assembly. These devices are arranged to react to a malfunction, making it possible to minimize further damage caused by the malfunction. In addition, if a malfunction occurs, the information available from the devices can be utilized when carrying out repair and/or protective measures. The necessary measures can be easily incorporated in the control of the paper machine, so that especially in critical positions at least the initial measures for avoiding further damage are wholly automatic. The method according to the invention can be easily applied to existing paper machines. In addition, the method can be used to improve the utilization of a paper machine.

BRIEF DESCRIPTION OF THE DRAWINGS

In the following, the invention is examined in detail with reference to the accompanying drawings depicting some embodiments of the invention, in which.

DESCRIPTION OF THE PREFERRED EMBODIMENTS

Figure 1:
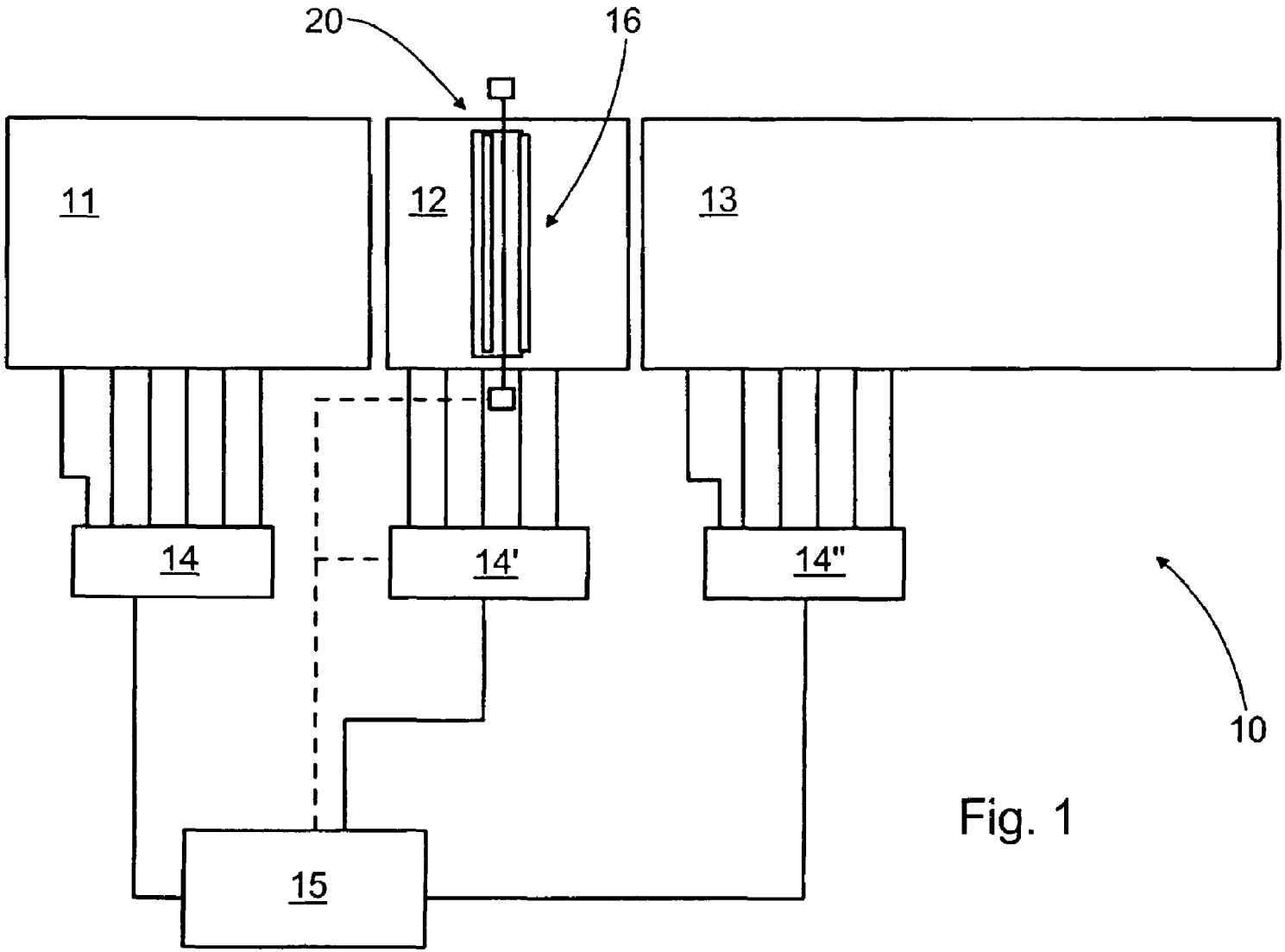
FIG. 1 shows a schematic diagram of the doctor assembly according to the invention applied to a paper machine, as well as of the control devices of the paper machine.

FIG. 1 shows a schematic diagram of a paper machine 10, that is, as such, known. In this case, the term paper machine also refers to a board machine or similar. In FIG. 1, the paper machine 10 is divided into three sub-totalities. The first of these, in the production direction of the paper machine 10, is the web formation section 11, the second being the press section 12, followed by the drying section 13 with the finishing equipment. Modern paper machines incorporate a great deal of highly developed control equipment. For reasons of clarity, the control devices 14-14" in FIG. 1 are shown schematically as being separate from each sub-totality 11-13. The control devices include, for instance, various sensors and the meters connected to them, as well as operating devices and the means required to control them.

Nowadays all, or at least most of the control devices 14-14" also are further connected to form a control centre 15, allowing the entire paper machine to be monitored and controlled centrally from a single location, such as a control room.

Figure 2:
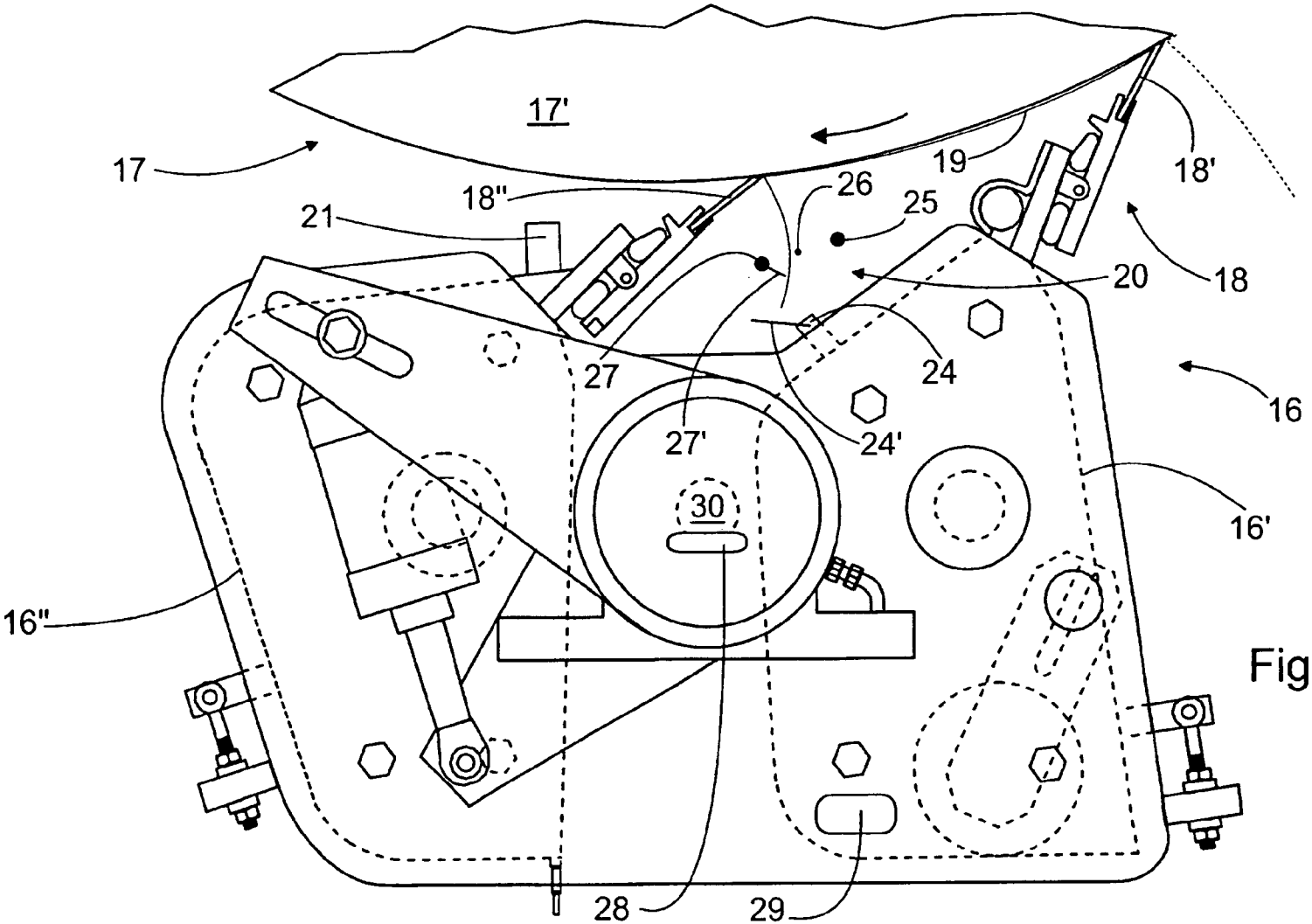
FIG. 2 shows a side view of the doctor assembly according to the invention applied in connection with a roll.

The doctor assembly 16 according to the invention is intended to scrape a moving surface 17 (FIG. 2). In a paper machine, the surface being doctored is usually the surface of a roll 17' or a belt. In the doctor assembly in question, there is at least one doctor member 18, which is in practice generally a doctor blade 18', arranged in contact with the surface 17. The doctor member 18 is used to scrape the moving surface 17 and thus remove material used in the paper machine from the surface. The material can be, for instance, fine material that adheres to the surface of a roll during production. Doctoring with the doctor member thus keeps the surface of the roll clean. However, the material can also be the paper web 19 itself, which is doctored off the surface of the roll 17, for example, during so-called running down (FIG. 2). FIG. 1 shows a doctor assembly 16, which is fitted to the press section, as larger than it really is. The rolls forming the press nip are not shown, but in practice the doctor assembly 16 shown is located below the lowest roll 17' of the relevant rolls, according to FIG. 2. In this case, the doctor assembly 16 is formed of two doctor beams 16' and 16" with doctor blades 18' and 18" fitted to them. Besides the press rolls, other critical doctor assemblies are located in connection with the transfer belts and the first and last dryer rolls.

To prevent damage and production losses, detector devices 20 are arranged in connection with the doctor assembly 16, to detect any malfunction of the doctor assembly. The most serious malfunctions are a poor doctoring effect by the doctor blade and a drop through. According to the invention, the detector devices 20 can be of many different kinds, but each of them is connected to the control devices 14-14' of the paper machine 10, for carrying out repair and/or protective measures. A message of a malfunction given by the detector devices can be converted into a signal, for example to the control room, so that the requisite measures can be started immediately. The control devices can also be set to carry out specific measures immediately a message is received, as manual repair and/or protective measures are often too slow. Thus, the most critical measures take place automatically. Such measures include, especially in the press section, raising the pick-up roll, lightening the nip load, and opening the doctors. Raising the pick-up roll will run the web down between the web formation section and the press section, thus preventing the web traveling on to a doctor assembly that has dropped through. A web break and running down can be accelerated by releasing the vacuum from the pick-up roll. Correspondingly, excess pressure can be lead to the pick-up roll. The necessary measures can also be easily programmed to form a specific sequence, making most operations simultaneous. The malfunction can then be eliminated as quickly as possible, without damaging neighbouring structures. This also shortens the production break caused by the malfunction. The detector devices 20 can be connected to the control devices 14-14" or to the control center 15, either over a permanent connection, or wirelessly, as depicted by a broken line in FIG. 1.

Generally, the detector devices are arranged after the doctor member, in the direction of travel of the moving surface. The detector devices can then be used to detect if the doctor member has dropped through, or if its doctoring effect is poor. Normally there is no material on the surface after the doctor member. Similarly, for example, with a double doctor in the press section it will be detected if the pulper is becoming full for some reason. In a double doctor, detector devices are also preferably fitted after the second doctor blade (FIG. 2). This will detect a malfunction in which both doctor blades drop through. Though this case is certainly unusual, it generally causes great damage. This is because if both doctor blades drop through, the paper web will wind itself around the roll. FIG. 2 shows the first doctor blade 18' of the doctor assembly 16 at the moment it drops through. The paper web 19 then strikes the second doctor blade 18" and leaves the surface of the roll 17', to strike the detector devices 20. Normally, when running down, the first doctor blade 18' detaches the paper web 19, creating the situation shown by the broken line in FIG. 2. The same reference numbers are used for functionally similar components.

Figure 3:
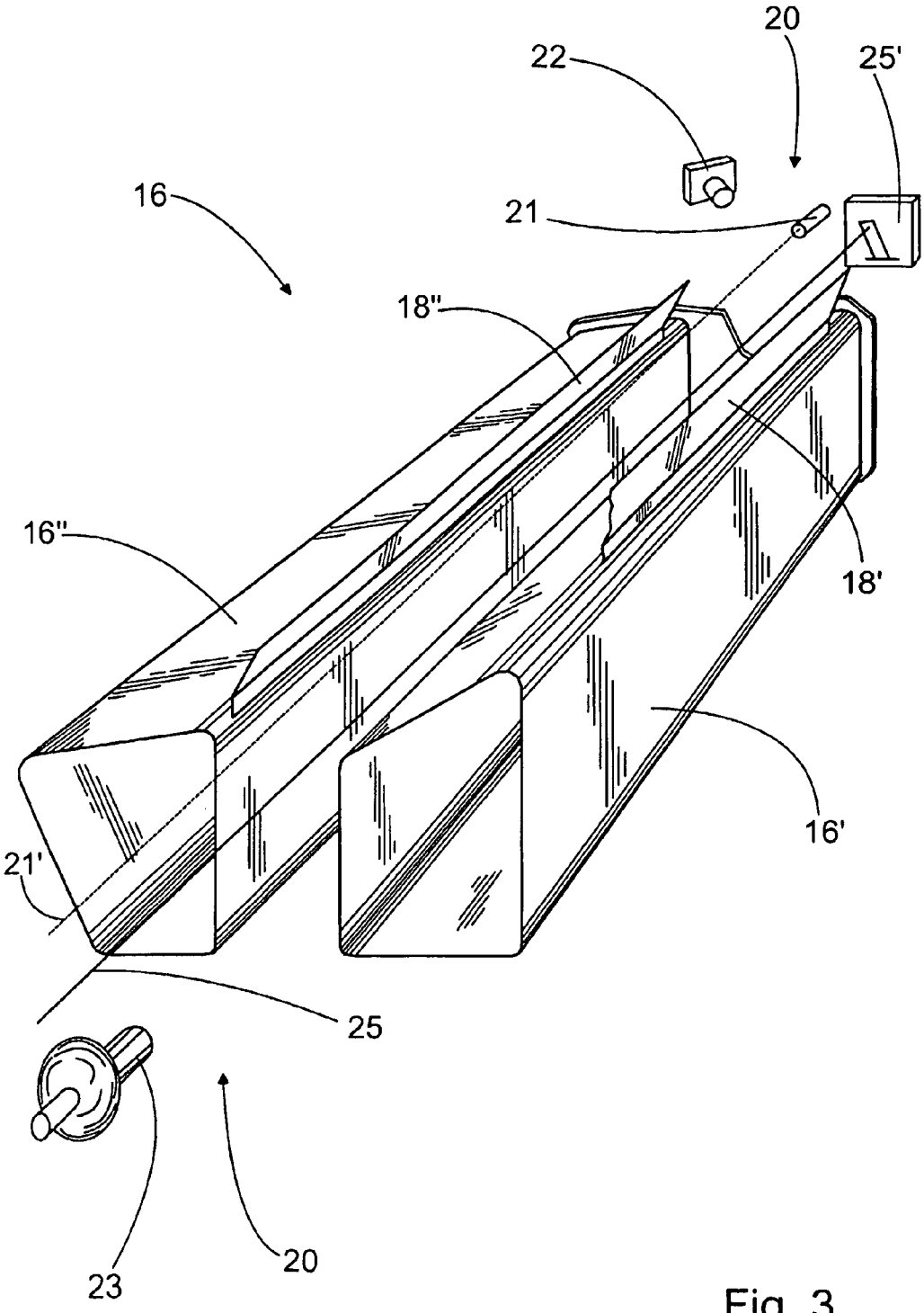
FIG. 3 shows a perspective view and cross-section of part of the doctor assembly of FIG. 2.

The following describes various detector devices and their operation. Detector devices operating on different principles can be fitted to the same doctor assembly, thus achieving good operating reliability and avoiding false alarms. In addition, measures are preferably taken only if a malfunction is detected by two detector devices of different types. It is also preferable to place several detector devices of the same type in the same doctor assembly, as this will improve the reliability of the detector devices. According to the invention, the detector devices are formed of contact-less members, such as optical, acoustic, or other similar members. The said members are fitted to one or both ends of the doctor assembly. The members can also be located at, for instance, suitable intervals over the entire length of the doctor assembly. In practice, the optical members are arranged to react to material appearing during a malfunction, on the moving surface and/or on top of the doctor assembly. Detection can be implemented in several different ways. One way is to use photocells placed at both ends of the doctor assembly. In that case, if a malfunction occurs, the material collecting on the doctor assembly will break the beam between the photocells, causing a signal to be transmitted to the control devices of the paper machine. FIG. 3 shows the transmitter photocell 21 and the beam 21' sent by it. The light used can be visible light, a laser beam, or infrared or other light with a specific wavelength. In addition, at the other end of the doctor assembly, it is possible to arrange simply a reflector, which, however, will make the system more liable to malfunction than the previous arrangement. Optical sensors can also be advantageously installed in a tubular casing, which will prevent them from dirtying (FIG. 3). Despite the need for the casing, photocells and other similar optical sensors are small and economical.

Various cameras, which react to changes in tone or shape are also suitable for use as optical sensors. In particular, this will make it possible to be certain that the paper web is in place, as a paper web is generally considerably lighter in tone, than, for example, the surface of a roll. Reliability can be improved by lighting with a light that is reflected by the fillers in the paper web. This is an especially good way of detecting a drop through of the second doctor blade. In addition, it is possible to use machine vision, which can be calibrated to a specific normal situation. If a malfunction occurs, the machine vision detects that the situation has changed and gives an alarm. Machine vision is also suitable for the longer term monitoring of the operation of the doctor assembly. It is then possible to detect the gradual dirtying or wear of the surface being doctored, making it easier to plan maintenance shutdowns. FIG. 3 shows only one camera 22, though there can be several, if necessary.

In case of a malfunction, the sound around the doctor assembly also changes. The acoustic members used will then react to the sound caused by the malfunction. At their simplest, the acoustic members comprise one or more microphones, which are set to a specific noise level, levels above which cause the apparatus to give a signal of a malfunction. However, sound of a specific frequency may even diminish during a malfunction. Ultrasound sensors are also appropriate. These can be used to detect not the sound level, but the material. Modern ultrasound sensors are cheap, simple, and fast. It is preferable to use a so-called directional microphone 23, according to FIG. 3, as the microphone, or else a microphone used in so-called acoustic emission measurement, which if attached to the doctor beam, blade holder, or doctor blade will react to sound traveling in these structures.

Though most of the aforementioned detector devices are small in size and reliable in operation, they will require calibration according to their current operating environment.

The detector devices according to the invention can also be mechanical members, fitted in the area between the ends of the doctor assembly. Some of the members can be installed outside of and in connection with the ends (FIG. 3), which will facilitate installation and maintenance. In addition, mechanical members are arranged to react to the force of the material collecting on them during a malfunction. Thus, they can be easily manufactured to suit many different kinds of doctor assembly. Generally, the mechanical members include one or several state sensors 24 with a projection 24' attached, on top of which material is intended to collect to operate the state sensor 24. FIGS. 2 and 3 show three different mechanical members. The first is a cable 25 stretched between the ends of the doctor assembly 16, with one end attached to a suitable sensor construction 25'. Besides a cable, it is also possible to use, for example, a wire or similar thin member. If the first doctor blade 18' drops through, the paper web 19 will strike the suitably positioned cable 25, signaling a malfunction (FIG. 2). The cable 25 is preferably intended not to break, so that it only needs to be installed once. Alternatively, it is possible to use a thinner fibre, or for example an electrical conductor 26, the breaking of which signals a malfunction. The conductor 26 itself then forms both the projection and the state sensor. Further, instead of a cable, it is possible to use a thin shaft 27, with suitable barbs 27' attached, according to FIG. 2. A malfunction is then detected on the basis, not of bending, but of the rotation of the shaft 27, which is detected using an angle sensor (not shown) set on the shaft 27. The mechanical members described above extend over the entire distance of the doctor assembly. Due to the long distance, their constructions must be dimensioned strongly and their installation may be laborious. Small and light constructions can be advantageously used by installing several state sensors 24 at suitable intervals on the doctor beam 18'. The mechanical member shown in FIG. 2 operates in the manner described. A projection 24' is attached to the state sensor 24, and is struck by the paper web 19 in case of a malfunction. As the mechanical members referred to above are round and thin, practically no fine material collects on top of them. This avoids false alarms.

Nearly all of the detector devices described above are based primarily on the detection of material during a malfunction. In addition to them, it is possible to use detector devices that are adapted to react to a change in some physical quantity in the doctor assembly that results from a malfunction. Especially if several sensors operating on different principles are used, a malfunction will be detected rapidly and certainly, while at the same time avoiding false alarms. According to the invention, the detector devices are sensors, which react to the doctor assembly's temperature, pressure, vibration, mass, electrical conductivity, capacitance, or other physical quantity. For example, in a drop-through situation, a temperature sensor located after the doctor blade will detect a relatively warm paper web. The same temperature sensor can also react to the temperature of the roll. In case of a malfunction, the doctor assembly generally also vibrates noticeably. FIGS. 2 and 3 show different kinds of sensor. An increase in mass can be detected using, for example, strain sensors 28 connected to the bearings 30 of the doctor assembly 16. Correspondingly, electrical conductivity or capacitance will change if a damp paper web collects on top of the doctor beams 16 and 16', such a change being detected by a measurement sensor 29 fitted to the doctor beam 16'.

Figure 4:
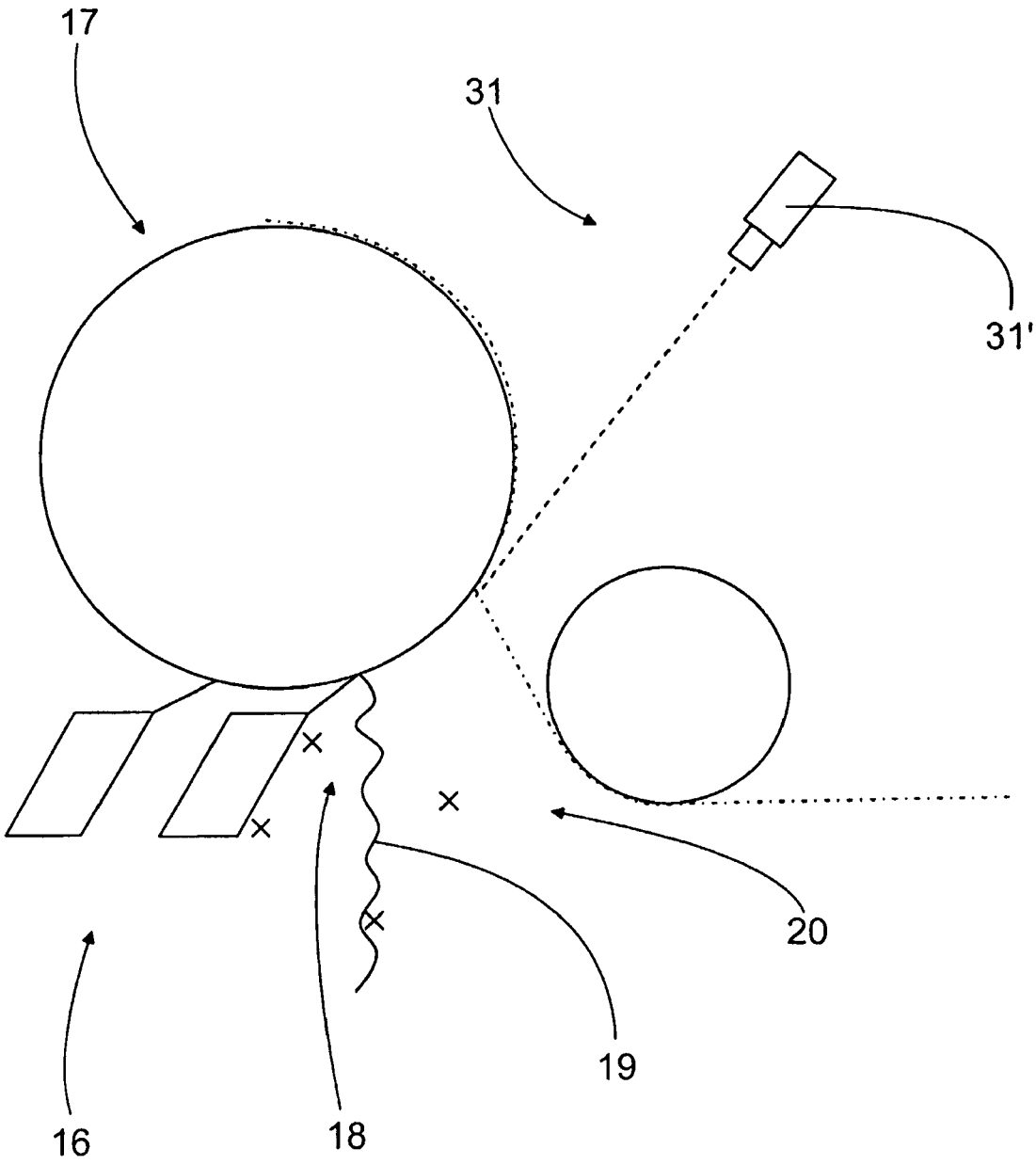
FIG. 4 shows a schematic diagram of a second embodiment of the doctor assembly according to the invention.

FIG. 4 shows a schematic diagram of a doctor assembly 16, a malfunction of which can be detected using detector devices 20 located in connection with the doctor assembly 16. The doctor assembly 16 also includes devices 31 arranged to detect the normal situation in the paper machine. In the normal situation, the web travels without disturbance. The path of travel of the web is shown in FIG. 4 by a line of alternating dashes and dots. The said devices 31 can be, for example, laser distance meters 31' which are used to detect the point where the web detaches. According to the invention, the devices 31 are connected to detector devices 20, which are fitted before the doctor member 18 in the direction of travel of the moving surface 17, and which are arranged, during a malfunction detected by the devices 31, to detect the absence of material before the doctor member 18, in order to detect a malfunction of the doctor assembly 16. In other words, if the web breaks, the material is removed by the doctor member 18. The web 19 will then drop according to the wavy line (FIG. 4). According to the invention, following a clear change in the point of detachment, the presence of material is monitored before the doctor member and especially below it. For this purpose, several detector members 20, at the various locations shown by the crosses in FIG. 4, are arranged in the doctor assembly 16. Generally, it is preferable for both the devices and the detector members to monitor the situation continuously. If the devices signal that the point of detachment is deviating, or that it is totally missing, and if the detector devices do not detect material, i.e. a dropping web, it is highly probable that the doctor assembly is malfunctioning. The necessary measures can then be carried out to eliminate the malfunction, as described previously.

Figure 5:
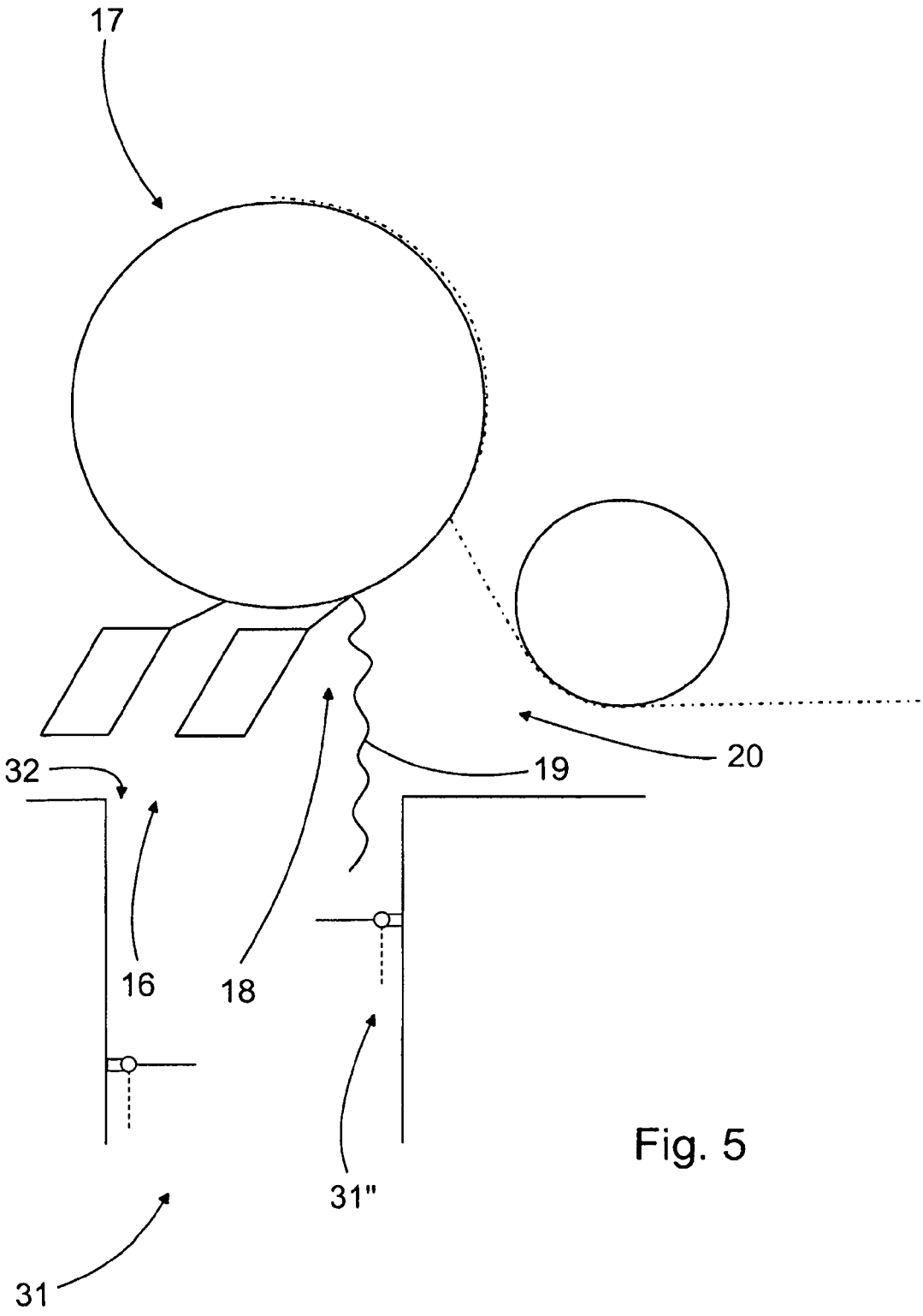
FIG. 5 shows a schematic diagram of a third embodiment of the doctor assembly according to the invention.

FIG. 5 shows a variation of the previous embodiment. In this case, detector members 31", which are arranged at the exit point of the material 19 to be removed, such as the pulper feed opening 32, are used as the devices 31. The detector members can also be in connection with the doctor member 18, or at both locations. If the pick-up roll is transferring the web to the press section, but the web is detected to be missing at the dryer section, the web 19 will be normally run down into the pulper, according to FIG. 5. The web 19 will then strike one of the detector members 31", showing that the doctor assembly is operating correctly. Correspondingly, if the doctor assembly 16 malfunctions, the detector members 31" will remain in the ready position, so that the absence of the material will be detected. In FIG. 5, the detector members 31" are shown in the ready position, their operating position being correspondingly shown by broken lines. The detector members can be mechanical, optical, and/or acoustic, as described above. In addition, the devices and members depicted in the description can be combined in the same position, which will increase the certainty of a malfunction being detected and also reduce the number of false alarms.

In the prior art, the only way to monitor the operation of a doctor assembly is mainly to stand next to it and watch it. Due to the large numbers of doctor assemblies, it is totally impossible to monitor the operation of each one continuously. In practice, malfunctions are mainly noticed by accident, usually by their sound, after which the paper machine's control devices are used to perform the necessary measures to eliminate the malfunction and carry out repair and/or protective measures. According to the invention, detector devices are arranged in connection with the doctor assembly to detect a malfunction and are also connected to the paper machine's control devices, to carry out the said measures automatically. This makes it possible, if desired, to continuously monitor each doctor assembly and also to largely avoid the damage caused by a malfunction. The detector devices are preferably located in connection with a double doctor forming a doctor assembly and particularly in the space between the first and second doctor members. This means that a drop through of particularly the first doctor blade will be detected. Further, detector devices are located in connection with a double doctor forming a doctor assembly in the press section of a paper machine. This will bring significant benefits, as this particular doctor assembly is known to be one of the most critical.

By means of the detector devices and/or members connected to it, the doctor assembly according to the invention will help to increase the utilization of a paper machine. By detecting malfunctions and using the control devices to carry out repair and/or protective measures, further damage will be effectively prevented. Use of the detector devices and/or members makes it possible to continuously monitor the operation of the doctor assembly, so that it will even be possible to predict malfunctions. According to the invention, the primary monitoring is of the situation after the doctor member, so that it is possible to detect numerous different malfunctions. The observations can be used secondarily to determine the condition of the doctor member, facilitating the planning of maintenance shutdowns. However, what is important is that the monitoring is continuous and the repair and/or protective measures are essentially carried out automatically. Besides the automated performance of repair and/or protective measures, these can also be carried out manually, if necessary, though this is often too slow, however. The detector devices and/or members and method according to the invention can easily be applied in various doctor assemblies. These include not only double doctors, but other doctors, in which the surface being doctored is usually a roll or a belt, such as a transfer belt.

The invention claimed is:

1. A method for monitoring the operation of a doctor assembly having a first doctor member, in a paper machine making a paper web, the method comprising the steps of:

scraping material or the paper web off a moving surface which moves in the machine direction, with the first doctor member;

monitoring the moving surface directly with an optical member after the moving surface has passed the first doctor member in the machine direction, and checking with the optical member for the material or the paper web present on the moving surface; and when the optical member detects the material or the paper web present on the moving surface carrying out, with paper machine control devices connected to the detector devices, running down the web being manufactured on the paper machine, before the first doctor member, in order to eliminate the malfunction caused by the drop-through and to carry out repair and/or protective measures.

2. The method of claim 1, wherein the doctor assembly includes the first doctor member and a second doctor member, and wherein the step of monitoring the moving surface directly with an optical member comprises using an optical member located after the second doctor member.

3. The method of claim 2, further comprising using the double doctor assembly in a press section of the paper machine.

4. The method of claim 2, further comprising directing a light that is reflected by fillers in the paper web at the moving surface, after the moving surface has passed the first doctor member, and detecting said light with the optical member.

5. The method of claim 2, wherein the optical member is a camera, further comprising using the camera to monitor the moving surface for a change from a darker to a lighter tone to detect the material or the paper web present.

6. The method of claim 2, wherein the optical member is a camera, and further comprising using the camera with machine vision to calibrate a specific normal situation, and to detect the material or the paper web present by a change in the specific normal situation.

7. The method of claim 2, wherein the step of monitoring the moving surface directly comprises monitoring the moving surface directly with a plurality of optical members.

8. The method of claim 1, wherein the step of running down the web being manufactured on the paper machine, comprises at least one measure taken from the group consisting of: rasing a pick-up roll, releasing vacuum from a pick-up roll, creating excess pressure in the pick-up roll, or releasing a loading pressure from the doctor assembly.

9. A method for monitoring the operation of a doctor assembly having a first doctor member, in a paper machine making a paper web, the method comprising the steps of:

scraping material or the paper web off a moving surface which moves in the machine direction, with the first doctor member;

monitoring the moving surface directly with a temperature sensor after the moving surface has passed the first doctor member in the machine direction, and checking with the temperature sensor for the material or the paper web present on the moving surface; and when the temperature sensor detects the material or the paper web present on the moving surface carrying out, with paper machine control devices connected to the detector devices, running down the web being manufactured on the paper machine, before the first doctor member, in order to eliminate the malfunction caused by the drop-through and to carry out repair and/or protective measures; wherein the temperature sensor reacts to a change in temperature, detecting a warm paper web or reacting to the temperature of the roll.

10. A method for monitoring the operation of a doctor assembly having a doctor beam and a first doctor member mounted to the doctor beam, in a paper machine making a paper web, the method comprising the steps of:

scraping material or the paper web off a moving surface which moves in a machine direction, with the first doctor member;

monitoring the material or the paper web collecting on the doctor beam during a malfunction downstream of the first doctor member with a plurality of mechanical state sensors, having projections arranged so that during a malfunction the material or the paper web collects on said projections such that the plurality of mechanical state sensors react to force caused by the material or the web collecting on them during malfunctions; and when the plurality of mechanical state sensors detect the material or the paper web collecting on said projections, carrying out, with paper machine control devices connected to the plurality of mechanical state sensors, running down the web, before the first doctor member, in order to eliminate a malfunction caused by a drop-through of the first doctor member.

11. A method for monitoring the operation of a doctor assembly having a first doctor member including a doctor beam, a doctor holder and a doctor blade, in a paper machine making a paper web, the method comprising the steps of:

scraping material or the paper web off a moving surface which moves in a machine direction, with the first doctor member;

monitoring a malfunction of the first doctor member with acoustic members which react to sound; and when the acoustic members detect a change in sound, carrying out, with paper machine control devices connected to the detector devices, running down the web, before the first doctor member, in order to eliminate a malfunction caused by a drop-through of the first doctor member.

12. The method of claim 11, wherein the step of monitoring the malfunction of the first doctor member comprises: preforming acoustic emission measurement, with a microphone attached to the doctor beam, blade holder, or doctor blade and detecting sound traveling in said doctor beam, blade holder, or doctor blade.

13. The method of claim 12, wherein the acoustic emission measurement is preformed with respect to ultrasound.

14. A method for monitoring the operation of a doctor assembly having a first doctor member, in a paper machine making a paper web, the method comprising the steps of:

scraping the paper web off a moving surface which moves in a machine direction, with the first doctor member;

monitoring the moving surface with first detector devices arranged upstream in the machine direction from the first doctor member, to detect the paper web on the moving surface upstream of the first doctor member to thus detect normal operation of the paper machine up to the first doctor member;

monitoring with second detector devices spaced from the first doctor member in an upstream direction, the presence of the paper web below the first doctor member which paper web has been removed from the moving surface; and wherein when the paper web is present upstream of the first doctor member but not present below the first doctor member and thus is detected a malfunction of the first doctor assembly, carrying out, with paper machine control devices connected to the detector devices, running down the web, before the first doctor assembly, in order to eliminate the malfunction caused by a drop-through of the first doctor member.

15. A method for monitoring the operation of a doctor assembly having a first end and a second end, the doctor assembly having a doctor beam, the doctor beam extending between the doctor assembly first end and second end, and a first doctor member mounted to the doctor beam, in a paper machine making a paper web, the method comprising the steps of:

scraping material or the paper web off a moving surface which moves in a machine direction, with the first doctor member;

monitoring the material or the paper web collecting on the doctor beam during a malfunction downstream of the first doctor member with a thin member extending between the first end and the second end of the doctor assembly so that during a malfunction the material or the paper web collects on said thin member, and activates a sensor attached to an end of the thin member; and when the sensor detects the material or the paper web collecting on said thin member carrying out, with control devices in the paper machine which are connected to said sensor, running down the web, before the first doctor member, in order to eliminate a malfunction caused by a drop-through of the first doctor member.

16. The method of claim 15 wherein the thin member is a shaft which is rotated by the material or the paper web collecting on the doctor beam, and further comprising the step of monitoring the material or the paper web collecting on the doctor beam by monitoring said rotation.

17. The method of claim 15 wherein the thin member is a shaft which is rotated by the material or the paper web collecting on the doctor beam, said rotation detected using an angle sensor set on the shaft.

18. A method for monitoring the operation of a doctor assembly having a first end and a second end, the doctor assembly having a doctor beam, the doctor beam extending between the doctor assembly first end and second end, and a first doctor member mounted to the doctor beam, in a paper machine making a paper web, the method comprising the steps of:

scraping material or the paper web off a moving surface which moves in a machine direction, with the first doctor member;

monitoring the material or the paper web collecting on the doctor beam during a malfunction downstream of the first doctor member with a beam of light so that during a malfunction the material or the paper web collects on said doctor beam, and breaks said beam of light which is detected by a sensor; and when the sensor detects the light beam is broken, with control devices in the paper machine which are connected to said sensor, running down the web, before the first doctor member, in order to eliminate a malfunction caused by a drop-through of the first doctor member.

19. The method of claim 18 wherein the beam of light extends between the first end and the second end of the doctor assembly.

20. The method of claim 18 wherein the beam of light extends between photocells.

21. The method of claim 18 wherein the beam of light is a laser light beam.

22. A method for monitoring the operation of a doctor assembly having a first end and a second end, the doctor assembly having a doctor beam, the doctor beam extending between the doctor assembly first end and second end, and a first doctor member mounted to the doctor beam, in a paper machine making a paper web, the method comprising the steps of:

scraping a moving surface which moves in a machine direction, with the first doctor member to remove the paper web;

monitoring a pulper feed opening positioned below the first doctor member to receive the paper web removed from the moving surface, to detect the presence of the paper web in the pulper feed opening;

monitoring the presence of the paper web in a dryer section after the doctor assembly in the paper machine; and if the web is not present in the dryer section and the paper web is not detected in the pulper feed opening, using control devices connected to the paper machine to run down the web, before the first doctor member, in order to eliminate a malfunction caused by a drop-through of the first doctor member.

23. A method for monitoring the operation of a doctor assembly having a first end and a second end, the doctor assembly having a doctor beam, the doctor beam extending between the doctor assembly first end and second end, and a first doctor member mounted to the doctor beam, in a paper machine making a paper web, the method comprising the steps of:

scraping material or the paper web off a moving surface which moves in a machine direction, with the first doctor member;

monitoring the material or the paper web collecting on the doctor beam during a malfunction downstream of the first doctor member with a measurement sensor fitted to the doctor beam so that during a malfunction the material or the paper web collects on said doctor beam and changes the electrical conductivity or capacitance of the doctor beam said change being detected by said measurement sensor; and when the measurement sensor detects changes in the electrical conductivity or the capacitance of the doctor beam, with control devices in the paper machine which are connected to said sensor, running down the web, before the first doctor member, in order to eliminate a malfunction caused by a drop-through of the first doctor member.

24. A method for monitoring the operation of a doctor assembly, having a first end and a second end, the doctor assembly having a doctor beam, the doctor beam extending between the doctor assembly first end and second end, and a first doctor member mounted to the doctor beam, in a paper machine making a paper web, the method comprising the steps of:

scraping material or the paper web off a moving surface which moves in a machine direction, with the first doctor member;

monitoring the material or the paper web collecting on the doctor beam during a malfunction downstream of the first doctor member with mass measuring sensors fitted to the doctor beam so that during a malfunction the material or the paper web collects on said doctor beam and changes the mass of the doctor beam, said mass being detected by said mass measurement sensors; and when the measurement sensor detects a change in the mass of the doctor beam, with control devices in the paper machine which are connected to said sensors, running down the web, before the first doctor member, in order to eliminate a malfunction caused by a drop-through of the first doctor member.

25. The method of claim 24 wherein the doctor assembly is mounted to the paper machine by bearings, and the mass sensors are strain sensor connected to the bearings of the doctor assembly, and wherein the step of monitoring the material or the paper web collecting on the doctor beam comprises measuring the output of the strain sensors.

* * * * *